US005275630A

United States Patent [19]

Dorer

[11] Patent Number: 5,275,630

[45] Date of Patent: Jan. 4, 1994

[54] METAL SALT FUEL ADDITIVE STABILIZED WITH A THIADIAZOLE

[75] Inventor: Casper J. Dorer, Lyndhurst, Ohio

[73] Assignee: The Lubrizol Corporation, Wickliffe, Ohio

[21] Appl. No.: 28,645

[22] Filed: Mar. 5, 1993

Related U.S. Application Data

[63] Continuation of Ser. No. 933,600, Aug. 20, 1992, abandoned, which is a continuation of Ser. No. 703,536, May 21, 1991, abandoned, which is a continuation of Ser. No. 593,294, Oct. 2, 1990, abandoned, which is a continuation of Ser. No. 928,062, Nov. 6, 1986, abandoned.

[51] Int. Cl.[5] ..... C10L 1/24

[52] U.S. Cl. ..... 44/341; 44/358; 44/363

[58] Field of Search ..... 44/341, 358, 363

[56] References Cited

U.S. PATENT DOCUMENTS

| | | | |
|---|---|---|---|
| 2,199,828 | 5/1940 | Bogdan | 556/6 |
| 2,560,542 | 7/1951 | Bartleson et al. | 44/305 |
| 2,719,125 | 9/1955 | Roberts | 44/341 |
| 2,719,126 | 9/1955 | Fields et al. | 252/47 |
| 2,764,547 | 9/1956 | Fields | 44/341 |
| 2,905,639 | 9/1959 | Krzikalla et al. | 252/32.7 R |
| 3,058,990 | 10/1962 | Harman | 548/130 |
| 3,641,046 | 2/1972 | Gates, Jr. et al. | 260/308 R |
| 3,663,561 | 5/1972 | Blaha | 260/302 SD |
| 3,701,729 | 10/1972 | Fischer et al. | 252/1 |
| 3,751,235 | 8/1973 | Schoen | 44/58 |
| 3,840,549 | 10/1974 | Blaha et al. | 260/302 SD |
| 3,909,420 | 9/1975 | Turnquest et al. | 252/47 |
| 4,000,082 | 12/1976 | Otrhalek et al. | 252/135 |
| 4,141,693 | 2/1979 | Feldman et al. | 44/68 |
| 4,162,986 | 7/1979 | Alkaitis et al. | 252/33.2 |
| 4,202,671 | 5/1980 | Diehl et al. | 44/68 |
| 4,410,436 | 10/1983 | Holstedt et al. | 252/46.4 |
| 4,412,928 | 11/1983 | Holstedt et al. | 252/46.4 |
| 4,427,560 | 1/1984 | Holstedt et al. | 252/42.7 |
| 4,505,718 | 3/1985 | Dorer, Jr. | 44/66 |

*Primary Examiner*—Ellen M. McAvoy
*Attorney, Agent, or Firm*—David M. Shold

[57] ABSTRACT

A two component additive and a liquid hydrocarbon based fuel composition, containing the additive are disclosed. The fuel composition is comprised of a major amount of a liquid hydrocarbon diesel fuel and a minor fuel efficiency improving amount of the additive. The additive is composed of: (A) an overbased transition metal salt of a carboxylic acid; and (B) a compound represented by the general formula II:

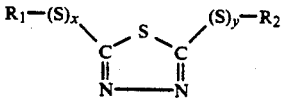

wherein $R_1$ and $R_2$ are independently hydrocarbyl. The additive may include a third component (C) which is a hydrocarbon-soluble ashless dispersant. The dispersant (C) is preferably a derivative of a substituted succinic acid wherein the hydrocarbyl substituent is derived from a polyalkylene characterized by a Mn value of about 500 to about 10,000 and a Mw/Mn value of about 1.0 to about 4.0.

54 Claims, No Drawings

METAL SALT FUEL ADDITIVE STABILIZED WITH A THIADIAZOLE

This is a continuation of copending application Ser. No. 07/933,600 filed on Aug. 20, 1992, now abandoned, which is a continuation of 07/703,536 filed on May 21, 1991, now abandoned, which is a continuation of Ser. No. 07/593,294, filed Oct. 2, 1990, now abandoned, which in turn is a continuation of Ser. No. 06/928,062 filed on Nov. 6, 1986, now abandoned.

FIELD OF THE INVENTION

This invention relates to the field of fuel additives and fuel compositions and concentrates containing such additives. More specifically, the invention relates to additive compositions comprised of an overbased transition metal salt of an organic acid and a hydrocarbyl substituted dimercaptothiadiazole as well as a means for stabilizing a fuel which includes a combustion promoter by including a thiadiazole additive in the fuel.

BACKGROUND OF THE INVENTION

A number of transition metal-containing compounds, both organic and inorganic, are known to be used for treatments for hydrocarbon systems. These compounds may be included within a hydrocarbon system such as a lubricant (e.g. greases, lubricating oils and the like) and hydrocarbon fuels of both the solid and normally liquid type. Such transition metal-containing compounds are effective catalysts for promoting combustion. Further, the components can promote conversion to cohesive films in the case of paints; and with respect to fuels such compounds can improve combustion properties. U.S. Pat. No. 4,505,718 to Dorer disclosed that the inclusion of transition metal salts of an organic acid can give property improving results when included within lubricants and fuels. Specifically, the inclusion of such metal salts into fuels can improve fuel efficiency. Specifically, manganese salt compounds are effective in reducing the combustion temperature of soot in diesel soot traps. However, it was also found that the inclusion of such metal salts into systems such as fuels sometimes causes deleterious as well as beneficial effects. Among the deleterious effects are the promotion of sediment and sludge in that a fuel containing a high concentration of a manganese salt is unstable with respect to oxidation. Sediments and sludges were found to form within such fuels. Accordingly, the use of such metal salts can cause deposits which interfere with the storage and transport of oil by promoting corrosion as well as interfering with pumps, meters and associated equipment. Accordingly, it was suggested within U.S. Pat. No. 4,505,718 to include an ashless dispersant preferably in the form of an acylated nitrogen-containing dispersant in combination with the transition metal salt in an attempt to eliminate the formation of the sediment and sludge.

Prior to the disclosure by U.S. Pat. No. 4,505,718 it had been known to include various types of transition metal salts into hydrocarbon systems such as fuels as disclosed by U.S. Pat. No. 4,162,986 to Alkitis et al. Further the inclusion of acylated nitrogen-containing dispersants into hydrocarbyl systems was previously known as indicated within U.S. Pat. No. 4,000,082. However, prior to the disclosure within the '718 patent the improved results obtained by including the dispersant in combination with the transition metal salt within a fuel composition was not known.

The literature includes literally hundreds of different disclosures of various compounds and compositions which have been found to be useful as used in connection with hydrocarbon systems such as lubricating oils and fuels. (See for example the citation of patents listed in U.S. Pat. No. 4,505,718). One type of compound which is known to be used in connection with certain types of hydrocarbon containing systems is a dimercaptothiadiazole. Such compounds may be included within hydrocarbon systems in order to act as elemental sulfur scavengers as disclosed within U.S. Pat. No. 3,840,549.

Although numerous compounds and compositions are disclosed as being used in connection with hydrocarbon systems such as lubricating oils and fuels, from time to time it is found that particular combinations of these compounds or compositions improves the properties of the resulting products. However, most combinations would tend to result in an undesirable interaction of the components. An example of a desirable combination was discussed above with respect to U.S. Pat. No. 4,505,718 wherein the conventional dispersant was used in connection with the transition metal salt in order to prevent the formation of sediments and sludge. The discovery of the usefulness of such combinations of known components can result in an extremely useful and commercially successful product. The reasons for this include (1) the relatively low cost; and (2) prior acceptability of such compounds and compositions within similar systems. Cost is often a tremendously important factor in that all compounds or compositions included within lubricating oils and fuels must be relatively inexpensive to make it commercially feasible to include the compounds within such hydrocarbon systems. In addition to the compounds and compositions themselves being inexpensive by combining certain ones in certain proportions it may be possible to eliminate the inclusion of other compounds or compositions which were previously required to obtain acceptable performance. This further reduces costs and increases the desirability of using such a combination.

The use of metal salts to improve efficiency was mentioned above with respect to U.S. Pat. No. 4,162,986. More recently such salts were found to be useful in connection with the spontaneous regeneration of a soot trap present in the exhaust system of a diesel engine. Such soot traps may be included in the exhaust system of a diesel engine in order to trap exhaust particulates. A build-up of such particulate material could clog the system and prevent the engine from operating. By including the metal salts in the fuel, the combustion temperature of the soot in the trap is effectively lowered and the trap is spontaneously regenerated and clogging is prevented. However, as the concentration of the metal in the fuel is increased, the oxidative stability of the fuel is decreased. This decreased stability results in the formation of sediments and sludge during storage.

SUMMARY OF THE INVENTION

The invention is a fuel additive composition and is more specifically an additive which includes at least components (A) and (B) (defined below) which are generally present in a liquid hydrocarbon based fuel. A preferred form of the fuel composition of the invention is comprised of a major amount of a liquid hydrocarbon diesel fuel and a property improving amount of the additive. A property improving amount of the additive is an amount sufficient to reduce or eliminate the formation of sludge and sediment and/or reduce the rate of formation of sludge and sediment while reducing the ignition temperature of the soot in a soot trap of a diesel engine exhaust system. The reduced ignition temperature is obtained by adding a metal salt (A) and the reduced sludge is obtained by adding a thiadiazole compound (B).

The additive includes: (A) an overbased transition metal salt of a carboxylic acid; and (B) a compound represented by the general formula II:

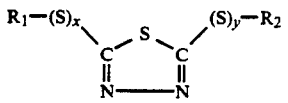

wherein $R_1$ and $R_2$ are independently hydrogen or hydrocarbyl. The additive preferably includes a third component (C) which is a hydrocarbon-soluble ashless dispersant. The dispersant (C) is preferably a derivative of a substituted succinic acid wherein the hydrocarbyl substituent is derived from a polyalkylene characterized by a Mn value of about 500 to about 10,000 and a Mw/Mn value of about 1.0 to about 4.0.

The invention also includes a means for stabilizing a fuel against oxidation during storage when the fuel is treated with a high concentration of metal salts (A).

A primary object of this invention is to provide a fuel additive composition.

Another primary object is to stabilize a diesel fuel containing a transition metal salt.

An advantage of this invention is that the additive is inexpensive to produce.

A feature of this invention is that it increases fuel efficiency while preventing the formation of sludge and sediment in the fuel.

These and other objects, advantages and features will become apparent to those skilled in the art upon reading this disclosure.

DETAILED DESCRIPTION OF THE PREFERRED EMBODIMENTS OF THE INVENTION

The essence of the invention is a fuel additive composition which is comprised of (A) an overbased transition metal salt of an organic acid; and (B) a compound represented by the general formula I:

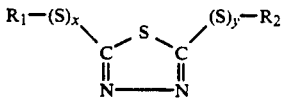

wherein $R_1$ and $R_2$ are independently hydrogen or hydrocarbyl and x and y are independently an integer in the range from about 1 to about 8. More preferably x and y are each 2 and $R_1$ and $R_2$ are independently selected from the group consisting of alkyl, aryl, and aralkyl containing at least 6 carbon atoms. Still more preferably $R_1$ and $R_2$ are independently an alkyl moiety containing from about 6 to about 24 carbon atoms. Some particularly preferred forms of $R_1$ and $R_2$ are independently selected from the group consisting of t-octyl, dodecyl, nonyl, decyl and ethylhexyl. A particularly preferred (B) is bis-2, 5-tert-octyldithio-1, 3,4-thiadiazole and 2-dodecyldithio5-mercapto-1,3,4-thiadiazole. The additive components (A) and (B) are most often and preferably used in combination with a hydrocarbon-soluble ashless dispersant (C).

The component (A) is preferably a carboxylic acid salt of titanium or manganese.

The components (A), (B) and (C) will now be described more fully.

(A) The transition metal salts. The transition metals in the organic salts of this invention are chosen from the group consisting of copper, scandium, titanium, vanadium, chromium, manganese, iron, cobalt, nickel and mixtures of two or more of these. Manganese salts and salts containing manganese in a mixture with other metals are most commonly used. Often salts containing only manganese are used. Lead salts can also be used but are not preferred due to environmental related reasons.

The organic acids used to make the transition metal salts used in this invention contain carbon atoms and include carboxylic acids, particularly those containing from 1 to 30 carbon atoms, sulfonic acids, particularly those containing an aromatic ring structure (e.g., benzene ring) substituted with one or more alkyl groups of 4 to about 22 carbon atoms, and phosphorus acids, containing within their structures one or more organic groups of 1 to about 30 or more carbon atoms.

Such carboxylic, sulfonic and phosphorus acids are well known to the art. The carboxylic acids can be mono-or polycarboxylic acids (if the latter, typically they are di- or tricarboxylic acids). Monocarboxylic acids include $C_{1-7}$ lower acids (acetic, propionic, etc.) and higher $C_{8+}$ acids (e.g., octanoic, decanoic, etc.) as well as the well known fatty acids of from about 12–30 carbon atoms. The fatty acids are often mixtures of straight and branched chain acids containing, for example, from 5 to about 30% straight chain acids and about 70 to about 95% (mole) branched chain acids. Other commercially available fatty acid mixtures containing much higher proportions of straight chain acids are also useful. Mixtures produced from dimerization of unsaturated fatty acid can also be used, as well as napthenic acids and various cyclic acids.

Higher carboxylic acids include the well known dicarboxylic acids made by alkylating maleic anhydride or its derivatives. The products of such reactions are hydrocarbon substituted succinic acids, anhydrides, and the like. Lower molecular weight dicarboxylic acids, such as the polymethylene bridged acids (glutaric, adipic, and the like), can also be used to make the salts of this invention as well as the lower molecular weight substituted succinic acids such as tetrapropenyl succinic acid and its analogs containing up to about $C_{30}$ substituted acids. Higher molecular weight substituted succinic anhydrides, acids, and analogs useful in making the salts of this invention have been described in a number of patents, particularly those dealing with acylated compounds useful as dispersants. Typical high molecular weight acids are those made by reacting a poly(isobutene) fraction having between 30 and 400 (usually 5–250) carbon atoms with maleic anhydride. Such materials are described in U.S. Pat. Nos. 3,172,892, 3,219,666 and 3,272,746 which are incorporated by reference herein for their disclosure of high molecular weight carboxylic acids. Other monocarboxylic acids of similar molecular weight can be made by alkylating acrylic acid and its analogs. Mixtures of such acids can also be used.

Useful salts can also be made from carbocylic carboxylic acid and even acidic hydroxy compounds such as alkylated phenols. Such materials are disclosed in U.S. Pat. No. 4,100,082, particularly columns 15–17, and these descriptions are incorporated by reference herein for such disclosure.

The '082 patent just identified also describes a number of sulfonic acids which are useful in making the salts of this invention. This patent, particularly columns 12–14, is incorporated by reference herein for its disclosure in this regard also.

Transition metal salts made from phosphorus acids are also useful in this invention. Such phosphorus acids have been disclosed in a number of U.S. patents and other literature. Exemplary of the former is U.S. Pat. No. 4,191,658 which discloses phosphorus acid salts of the formula

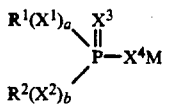

wherein M is a transition metal described above; each $R^1$ and $R^2$ is hydrocarbon radical; each of $X^1$, $X^2$, $X^3$ and $X^4$ is oxygen or sulfur; and each of a and b is 0 or 1.

Typically, the organic acids used to make the salts of this invention are carboxylic acid, sulfonic acid, or mixtures thereof. A particularly useful group of such salts are those described in U.S. Pat. No 4,162,986 to Alkaitis et al, which is hereby incorporated by reference for its disclosure of metallic organic compositions and, particularly, of transition metal salts of organic acids which are useful in the composition of the present invention. The present invention has been found to provide particularly advantageous results when the metal salt is an overbased manganese salt used as the only metal salt and present in a relatively high concentration.

It should be noted that the transition metal salts used in this invention are often overbased; that is, they contain more than sufficient metal to neutralize the acid present. In other words, they contain in excess of one equivalent of metal per equivalent of acid derived moiety Such salts are known to the art. See, for example, the just cited U.S. Pat. No. 4,162,986 as well as the following U.S. Pat. Nos.: 3,827,979 to Piotrowski et al., 3,312,618 to LeSuer et al., 3,616,904 and 3,616,905 to Asseff et al 2,595,790 to Norman et al., and 3,725,441 to Murphy et al. These patents are hereby incorporated by reference for their disclosure of overbased salts of organic acids.

The component (B) is represented by the general formula I:

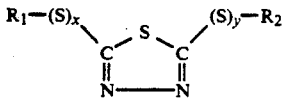

wherein $R_1$ and $R_2$ are independently hydrogen or a hydrocarbyl and x and y are independently an integer in the range from about 1 to about 8. More preferably x and y are each 2 and $R_1$ and $R_2$ are independently selected from the group consisting of alkyl, aryl, and aralkyl containing at least 6 carbon atoms. Still more preferably $R_1$ and $R_2$ are independently an alkyl moiety containing from about 6 to about 24 carbon atoms. Some particularly preferred forms of $R_1$ and $R_2$ are independently selected from the group consisting of t-octyl, dodecyl, nonyl, decyl and ethylhexyl. A particularly preferred (B) is bis-2, 5-tert-octyldithio-1,3,4-thiadiazole and mixtures of such compounds with a similar compound wherein one or both of the (—S,tert-octyl) moieties is replaced with hydrogen and 2-dodecyldithio-5-mercapto-1,3, 4-thiadiazole and mixtures of such compounds with a structurally similar compound where one or both of the (—S, dodecyl) moieties is replaced with hydrogen.

Also, as used herein, the terms "hydrocarbyl" or "hydrocarbon-based" denote a radical having a carbon atom directly attached to the remainder of the molecule and having predominantly hydrocarbon character within the context of this invention. Such radicals include the following:

(1) Hydrocarbon radicals; that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical). Such radicals are known to those skilled in the art; examples are (2) Substituted hydrocarbon radicals; that is, radicals containing non-hydrocarbon substituents, in the context of this invention, do not alter the predominantly hydrocarbon character of the radical. Those skilled in the art will be aware of suitable substituents; examples are (3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

Terms such as "alkyl-based radical," "aryl-based radical" and the like have meaning analogous to the above with respect to alkyl and aryl radicals and the like The radicals are usually hydrocarbon. Some radicals may be described as lower hydrocarbon, the word "lower" denoting radicals containing up to seven carbon atoms. Such radicals are generally lower alkyl or aryl radicals, most often alkyl The thiadiazole compound (B) is used in combination with the metal salt (A) in order to stabilize the fuel against oxidation during storage without destroying the combustion improving effect of (A).

(C) The ashless dispersants.

The ashless dispersants useful in the present invention are known to the art and are those dispersants commonly used in lubricants based on oils of lubricating viscosity and hydrocarbon fuels such as normally liquid hydrocarbon fuels. Ashless dispersants are those which leave little or no metallic residue or ash on combustion. Generally, this means that they are substantially metal free though they may contain, in addition to carbon, oxygen, hydrogen and often, nitrogen elements such as phosphorus, sulfur, boron etc.

Generally, the ashless dispersants of the present invention contain only C, H, O and N. Occasionally, ester type dispersants (see below) can contain only C, H, and O. More complex ashless dispersants, while still metal free, may also contain other elements, such as sulfur, boron, phosphorus, and the like. Typically, however, the ashless dispersants used in this invention are of the nitrogen-containing or nitrogen-free ester type.

Many types of ashless dispersants are known; see, for example, the descriptions in "Lubricant AdditiveRecent Developments" and the earlier "Lubricant Additives", both by M. W. Ranney, published by Noyes Data Corporation, Park Ridge, N.J., 1978 and 1973, respectively. Both these references and U.S. Pat. No. 4,136,043 are hereby incorporated by reference for their disclosure of ashless dispersants.

Among the more commonly available and, therefore, useful hydrocarbon-soluble ashless dispersants are:

(1) Acylated nitrogen-containing dispersants such as those described in U.S. Pat. No 4,100,082. which is incorporated by reference for its disclosure, particularly those at columns 18–20.

These dispersants are made by reaction of an acylating agent (e.g., carboxylic acid or anhydride) with an amino compound such as amine, polyamine, or other compound containing an —NH-group. Typical acylating agents include the substituted succinic acids described above and in the '082 patent. Other useful acylating agents have been described in detail in many other patents, such as U.S. Pat. No. 4,234,435 which describes in detail both acylating agents and amino-containing and non-amino containing compounds which can be used to prepare ashless dispersants. This patent is also incorporated in reference for its disclosure in this regard.

The acylated ashless dispersants useful in the present invention can be either the high or low molecular weight type. In addition to portions from amino compounds, they may also incorporate portions from mono and poly-alcohols, including amino hydroxy compound groups such as the well known amino alcohols. Typical ashless dispersants include those made from alkylene polyamines having 2 to 7 amino groups and 1 to 6 alkylene groups, each containing 2 to 4 carbon atoms. The commercially available ethylene polyamines are useful reagents in this regard.

Lower molecular weight acylated nitrogen-containing compounds are also useful as dispersants in the compositions of this invention. Such compounds are made from the aforedescribed amino compounds and mono and dicarboxylic acid acylating agents containing about 12 to about 20 carbon atoms. Such dispersants often contain imidazoline groups and are known to the art; see, for example, U.S. Pat. Nos. 3,405,064 and 3,240,575 which are incorporated by reference herein for their disclosure in this regard.

High molecular weight acylated nitrogen-containing ashless dispersants wherein an amino acid and alcohol compound (or amino-alcohol) both are acylated are also known and useful in the compositions of this invention; these are described in U.S. Pat. No. 4,136,043 which is incorporated by reference herein for its disclosure of such dispersants.

(2) High molecular weight nitrogen-free esters

These esters, as indicated above, are made by reacting the aforedescribed acylating agents (e.g., poly(isobutene) succinic anhydride with polyols and monoalcohols and are well known; see for example, U.S. Pat. No. 3,522,179, which is incorporated herein by reference for its disclosure of such esters.

(3) Hydrocarbyl substituted amines useful as ashless dispersants are known in the art; see for example, U.S. Pat. Nos. 3,275,554, 3,438,757, 3,454,555, and 3,565,804. A discussion of such materials also appears in the aforementioned "082 patent. All these patents are incorporated by reference herein for their disclosure of suitable hydrocarbyl amines for use as ashless dispersants in the present invention.

(4) Nitrogen-containing condensates of phenols, aldehydes and amino compounds.

Condensates made from reacting a phenol, aldehyde (such as formaldehyde) and amino compounds (such as those described above) are useful as ashless dispersants in the compositions of this invention. These materials are often generically known as Mannich condensates. Generally, they are made from reacting a hydrocarbon substituted phenol (e.g., an alkylated phenol having an alkyl group of about 34–400 carbon atoms), formaldehyde and an amino or polyamino compound having at least one —NH— group. A number of such materials are known to the art; see for example, the aforementioned '082 patent, particularly columns 21–22, and the references cited therein which is incorporated by reference herein for its disclosure of Mannich condensates and methods for making them.

The hydrocarbon-soluble compositions of this invention are made by combining (A) one or more of the aforedescribed transition metal salts of organic acids with (B) at least one of the aforedescribed hydrocarbon-soluble ashless dispersants. It should be noted that "hydrocarbon soluble" in describing this invention means that the material in question has a solubility at 25° C. of at least 0.0001 parts by weight in the hydrocarbon system in which it is to function. The combination of the materials (A) and (B) can be effected in any convenient manner. Usually, it is advantageous to avoid combining the salt and the dispersant directly since precipitation problems can thus be avoided. Therefore, it is common to combine either the dispersant or the salt with an inert, solvent diluent and then combine this material with the other and/or auxiliary agents. The solvent-/diluents used in the composition of this invention are usually hydrocarbyl in nature although they may contain small amounts of other hereto elements and are often highly aromatic to promote solubility. Auxiliary agents used in the compositions of this invention include dyes, anti-oxidants, metal deactivators, and, particularly, demulsifying agents which inhibit the tendency of the dispersant and/or the salt to promote emulsion formations in the vehicles it is used to treat, such as fuel, oils, lubricants and the like. Many such demulsifying agents are known; see, for example, Encyclopedia of Chemical Technology-Kirk-Othmer, Volume 8, pages 151 et seq. and Volume 19, pages 507 et seq. (1965). Typical demulsifying agents are surface active agents containing hydrophilic and lipophilic portions in the molecule. Such agents are often made by reacting a hydroxy compound, such as a phenol or alcohol, with materials such as ethylene oxide and propylene oxide and their mixtures in various proportions.

As indicated above, the compositions of this invention are used to treat lubricants based on lubricating oils of lubricating viscosity and hydrocarbon fuels. The lubricating oils are typically hydrocarbon in nature although they may contain non-hydrocarbyl portions, such as a synthetic ester, ether, and similar oils.

The fuels treated with the compositions of this invention include both solid and normally liquid fuels. Among the solid fuels are coal, shale, peat, wood, organic refuse, charcoal and the like Liquid fuels encompass the lighter petroleum fractions such as gasoline, kerosene, and the like, as well as other fractions such as middle distillate fuel oils. Typically middle distillate fuel oils which can be treated with the compositions in this invention include No. 1,2, and 4 fuel oils as defined by NASI/ASTM Standard D-396-79 and other such materials. Combinations of such fuel oils with straight run, vacuum run, and other specially treated residual oils can also be advantageously treated with the combinations of the present invention.

The concentration of the compositions of this invention in the treated lubricant or oil compositions is such that the treated lubricant or oil compositions contain about 1-500, preferably 5-350 ppm (by weight) transition metal* from component (A). The thiadiazole component (B) of the invention is generally added in an amount proportional to the amount of component (A) such that the weight ratio of (A):(B) is in the range of about (1-20):(1-20). The dispersant (C) is generally added in an amount so as to provide a weight ratio of (A):(B):(C) of about (1-20):(1-20):(2-40) and more preferably about (1):(1):(2). The component (C) is generally added so as to provide a composition which includes about 5-1000, preferably 10-800 ppm (by weight) ashless dispersant. In fuel oils, particularly, the composition is used to produce a transition metal concentration at about 10-400 ppm (by weight) and ashless dispersant concentration of about 15-450 ppm (by weight).

*The concentration of salt is expressed in terms of metal alone, but can be described in terms of grams of metal/gal of fuel. A liquid fuel composition will generally contain about 0.05 to about 7.5 grams metal/gal of fuel, more preferably 0.15 to about 1.5 grams metal/gal and most preferably about 0.75 grams metal/gal.

The most preferred metal salt (A) used is an overbased manganese salt which is most preferably present with both (B) and (C). The concentration of the Mn is generally described in terms of Mn/gal of fuel. It is difficult to describe the preferred ranges for the amount of manganese in that the results desired vary. For example, to increase the amount of soot burnt out of a soot trap the amount of manganese might be raised beyond the ranges indicated above. Such high concentrations of manganese (e.g. 5-20 grams/gal) are particularly unstable and require the addition of similarly higher amounts of (B) and (C).

EXAMPLE 1

A known ashless acylated nitrogen-containing dispersant may be prepared by reacting a mixture of poly(isobutene) substituted succinic anhydride acylating agent (having a substituent with a number average molecular weight equal to about 1,000) with a commerical mixture of ethylene polyamines averaging in composition triethylene tetra-amine. Carry out the reaction in aromatic solent/diluent with the proportion of acid to polyamine, by weight, of approximately 100 to 9; remove water and other low boiling products and impurities by heating to give the desired ashless dispersant having a nitrogen content of about 2% (by weight).

EXAMPLE 2

A hydrocarbon-soluble composition may be prepared by combining by weight, the following: (1) an overbased manganese carboxylate (containing 40% by weight Mn)-10.82 parts, (2) the ashless dispersant (of Example 1) 14.43 parts, (3) a first demulsifier —0.18 parts, (4) a second demulsifier —0.14 parts, (5) an aromatic solvent —74.43 parts, and (6) a thiadiazole compound 10 parts.

The above combination may be made by using the aromatic solvent in such a way as to avoid direct combination of the concentrated carboxylate and ashless dispersant. The combination has a specific gravity at 15.6° of 0.94, a pour point of —57° C., and a manganese content of 3.8-4.6 percent by weight.

(1) Sold by the Mooney Chemical Company as Mooney 910. (3) An Ethoxylated/Propylated Hydroxy Compound available as TOLAD 285 from The Tretolite Division of Petrolite Corporation, St. Louis, Missouri. (4) An Ethoxylated Propoxylated Pentaerythritol available as NALCO 5RD-648 from the Nalco Chemical Company of Houston, Texas. (5) HISOL Aromatic Solvent having a Kauri Gum-Butanol Value of 95. (6) Sold by Amoco as AMOCO 150 (other Amoco products which might be useful include AMOCO 158 and AMOCO 153).

EXAMPLE 3

An additive composition of the present invention may be formed by adding 10 parts by weight of an over based manganese carboxylate (A); 10 parts by weight of a thiadiazole and 20 parts by weight of a dispersant (C) of Example 1 (a suitable (A) is sold by Mooney Chemical Company as Mooney 910 and suitable (B) compounds include bis-2, 5-tert-octyldithio-1,3,4,-thiadiazole and/or 2-dodecyldithio-5-mercapto-1, 3,4-tiadiazole.

EXAMPLE 4

The composition of Example 2 may be used to treat a typical commercially available No. 2 middle distillate fuel oil. The treatment level is 1 part composition to 4600 parts by weight of fuel oil. This treatment level is equivalent to 10.7 parts per million manganese in the fuel. The treated fuel may be used to operate a commercial boiler and compared with use of untreated fuel in the same boiler under comparable conditions. The use of the compositions of this invention in the fuel, as described above, are believed to produce an efficiency improvement as reflected by reduced fuel consumption.

EXAMPLES 5-10

A deisel fuel oil composition can be prepared by adding component (A) to the fuel in the form of Mooney 910 as present in LZ 8220 (a product of the Lubrizol Corporation) so as to provide g/gal of Mn (as shown in table I) in the fuel and then adding the thiadiazole in the form of Amoco 150 so as to provide component (B) in the fuel in an amount as shown in table I.

TABLE I

| | g/gal Mn (LZ 8220) Component (A) | g/gal (AMOCO 150) Component (B) |
|---|---|---|
| Example 5 | 0.75 | 7.69 |
| Example 6 | 0.60 | 6.15 |
| Example 7 | 0.75 | 3.80 |
| Example 8 | 0.15 | 1.50 |
| Example 9 | 0.15 | 0.75 |
| Exmaple 10 | 0.15 | 0.38 |

While in accordance with the patent statutes, a best mode and preferred embodiments have been set forth, it is to be understood that various modifications thereof will become apparent to those skilled in the art upon reading of the specification. Therefore, it is to be understood that the invention disclosed herein is intended to cover such modifications as fall within the scope of the attached claims.

What is claimed is:

1. A fuel additive composition comprising:

(A) an overbased titanium or manganese salt of an organic acid; and (B) a compound represented by the general formula I:

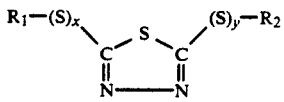

(I)

wherein $R_1$ and $R_2$ are independently hydrogen or a hydrocarbyl group containing about 8 to about 12 carbon atoms and x and y are independently an integer in the range of from about 1 to about 8, provided that at least one of $R_1$ or $R_2$ is said hydrocarbyl.

2. The additive of claim 1 wherein x and y are each 2 and $R_1$ and $R_2$ are independently selected from said hydrocarbyl groups.

3. The additive of claim 2 wherein $R_1$ and $R_2$ are independently selected from the group consisting of t-octyl, dodecyl, nonyl, decyl and ethylhexyl.

4. The additive of claim 1 wherein (B) is bis-2,5-tert-octyldithio-1,3,4-thiadiazole.

5. The additive of claim 1 wherein (B) is 2-dodecyldithio-5-mercapto-1,3,4-thiadiazole.

6. The additive of claim 1 wherein the organic acid is a carboxylic acid.

7. The additive of claim 1 wherein the metal is manganese.

8. The additive as claimed in claim 1, further comprising: (C) a hydrocarbon-soluble ashless dispersant.

9. A fuel composition comprising a major amount of a liquid hydrocarbon fuel and a minor amount of an additive comprising:

(A) an overbased titanium or manganese salt of an organic acid; and (B) a mixture of compounds represented by the general formula (I)

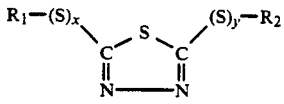

(I)

wherein $R_1$ and $R_2$ are independently hydrogen or a hydrocarbyl group containing about 8 to about 12 carbon atoms and x and y are independently an integer in the range of from about 1 to about 8 with the proviso that at least some (B) include compounds wherein x is 1, $R_1$ is hydrogen, and at least some (B) include compounds wherein and $R_2$ is said hydrocarbyl.

10. The fuel composition of claim 9 further comprising:

(C) a hydrocarbon-soluble ashless dispersant.

11. The fuel composition as claimed in claim 10 wherein the liquid hydrocarbon fuel is a diesel fuel and (A) is an overbased manganese metal salt of a carboxylic acid.

12. The fuel composition as claimed in claim 11 wherein the mixture of (B) includes at least some (B) which is dialkyl-substituted thiadiazole wherein the hydrocarbyl groups are selected from the group consisting of t-octyl, dodecyl, nonyl, decyl, and ethylhexyl.

13. The fuel composition as claimed in claim 12 wherein (C) is a substituted succinic acid or derivative thereof.

14. The fuel composition as claimed in claim 13 wherein (C) is a derivative of a substituted succinic acid and the substituent groups are derived from a polyalkylene characterized by a Mn value of about 500 to about 10,000 and a Mw/Mn value of about 1.0 to about 4.0.

15. The fuel composition as claimed in claim 9 wherein (A) is present in an amount of about 10 to about 8000 ppm and (B) is present in an amount of about 10 to about 200 ppm.

16. A liquid hydrocarbon based fuel composition, comprising a major amount of a liquid hydrocarbon diesel fuel and a minor fuel efficiency improving amount of an additive, comprising:

(A) an overbased manganese salt of a carboxylic acid; and (B) a compound represented by the general formula (II)

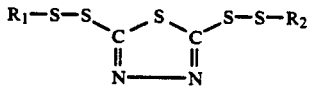

(II)

wherein $R_1$ and $R_2$ are independently hydrogen or hydrocarbyl groups containing about 8 to about 12 carbon atoms, provided that at least one of $R_1$ or $R_2$ is said hydrocarbyl.

17. A liquid hydrocarbon based fuel composition as claimed in claim 16 further comprising:

(C) a hydrocarbon-soluble ashless dispersant in the form of a derivative of a substituted succinic acid.

18. A liquid hydrocarbon based fuel composition as claimed in claim 17 wherein (C) is a hydrocarbyl substituted succinic acid or derivative thereof.

19. A liquid hydrocarbon based fuel composition as claimed in claim 18 wherein (C) is a derivative of a hydrocarbyl substituted succinic acid wherein the hydrocarbyl substituent is derived from a polyalkylene characterized by a Mn value of about 500 to about 10,000 and a Mw/Mn value of about 1.0 to about 4.0.

20. A method for stabilizing a liquid hydrocarbon based diesel fuel composition comprising a major amount of a liquid hydrocarbon diesel fuel and a minor fuel efficiency improving amount of an overbased manganese salt of a carboxylic acid, comprising:

adding to the fuel a compound represented by the general structural formula (II):

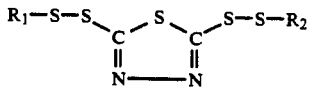

(II)

wherein $R_1$ and $R_2$ are independently hydrogen or hydrocarbyl groups containing about 8 to about 12 carbon atoms, provided that at least one of $R_1$ or $R_2$ is said hydrocarbyl; and adding a hydrocarbon-soluble ashless dispersant in the form of a derivative of a substituted succinic acid.

21. The method as claimed in claim 20, wherein the weight ratio of the (manganese salt):(compound of a formula (II)): (dispersant) is in the range of about (1-20):(1-20):(240).

22. A fuel additive composition comprising:

(A) an overbased titanium or manganese salt of an organic acid;

(B) a compound represented by the general formula I:

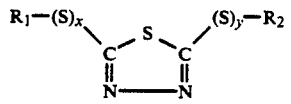

(I)

wherein $R_1$ and $R_2$ are independently hydrogen or a hydrocarbyl groups containing about 8 to about 12 carbon atoms and x and y are independently an integer in the range of from about 1 to about 8, provided that at least one of $R_1$ or $R_2$ is said hydrocarbyl; and (C) a hydrocarbon-soluble ashless dispersant; wherein the weight ratio of (A):(B):(C) is in the range of about (1-20):(1-20):(2-40).

23. The additive of claim 22 wherein x and y are each 2 and $R_1$ and $R_2$ are independently selected from the group consisting of t-octyl, dodecyl, nonyl, decyl, and ethylhexyl.

24. The additive of claim 22 wherein (B) is 2-dodecyldithio-5-mercapto-1,3,4-thiadiazole.

25. The additive of claim 22 wherein the organic acid is a carboxylic acid.

26. The additive of claim 22 wherein the metal is manganese.

27. The additive of claim 22 wherein the weight ratio of (A):(B):(C) is in the range of about (1):(1):(2).

28. The additive of claim 22 wherein (C) is a substituted succinic acid or derivative thereof.

29. The additive of claim 28 wherein (C) is a derivative of a substituted succinic acid and the substituent groups are derived from a polyalkylene characterized by a Mn value of about 500 to about 10,000 and a Mw/Mn value of about 1.0 to about 4.0.

30. A fuel composition comprising a major amount of a liquid hydrocarbon fuel and a minor amount of an additive comprising:

(A) an overbased titanium or manganese salt of an organic acid; and (B) a mixture of compounds represented by the general formula (I)

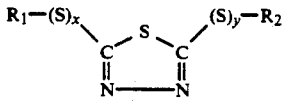

(I)

wherein $R_1$ and $R_2$ are independently hydrogen or a hydrocarbyl group having about 8 to about 12 carbon atoms and x and y are independently an integer in the range of from about 1 to about 8 with the proviso that at least some (B) include compounds wherein x is 1 and $R_1$ is hydrogen and at least some (B) include compounds wherein $R_2$ is said hydrocarbyl; and (C) a hydrocarbon-soluble ashless dispersant; wherein the ratio of (A):(B):(C) is in the range of about (1-20):(1-20):(2-40).

31. The fuel composition as claimed in claim 30 wherein the liquid hydrocarbon fuel is a diesel fuel and (A) is an overbased manganese metal salt of a carboxylic acid.

32. The fuel composition as claimed in claim 31 wherein the mixture of (B) includes at least some (B) which is dialkyl-substituted thiadiazole wherein the alkyl moieties are selected from the group consisting of t-octyl, dodecyl, nonyl, decyl, and ethylhexyl.

33. The fuel composition as claimed in claim 30 wherein (C) is a substituted succinic acid or derivative thereof.

34. The fuel composition as claimed in claim 33 wherein (C) is a derivative of a substituted succinic acid and the substituent groups are derived from a polyalkylene characterized by a Mn value of about 500 to about 10,000 and a Mw/Mn value of about 1.0 to about 4.0.

35. The fuel composition of claim 30 wherein the weight ratio of (A):(B):(C) is in the range of about (1):(1):(2).

36. The fuel composition of claim 30 wherein (A) is present in an amount of about 10 to about 8000 ppm and (B) is present in an amount of about 10 to about 200 ppm.

37. A liquid hydrocarbon based fuel composition, comprising a major amount of a liquid hydrocarbon diesel fuel and a minor fuel efficiency improving amount of an additive, comprising:

(A) an overbased manganese salt of a carboxylic acid; and (B) a compound represented by the general formula (II)

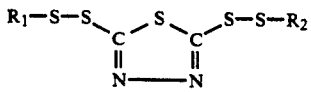

(II)

wherein $R_1$ and $R_2$ are independently hydrogen or hydrocarbyl groups containing about 8 to about 12 carbon atoms, provided that at least one of $R_1$ or $R_2$ is said hydrocarbyl, and (C) a hydrocarbon-soluble ashless dispersant; wherein the weight ratio of (A):(B):(C) is in the range of about (1-20):(1-20):(2-40).

38. A liquid hydrocarbon based fuel composition as claimed in claim 37 wherein (C) is a hydrocarbyl substituted succinic acid or derivative thereof.

39. A liquid hydrocarbon based fuel composition as claimed in claim 38 wherein (C) is a derivative of a hydrocarbyl substituted succinic acid wherein the hydrocarbyl substituent is derived from a polyalkylene characterized by a Mn value of about 500 to about 10,000 and a Mw/Mn value of about 1.0 to about 4.0.

40. A liquid hydrocarbon based fuel composition as claimed in claim 37 wherein the weight ratio of (A):(B):(C) is in the range of about (1):(1):(2).

41. A liquid hydrocarbon fuel composition as claimed in claim 37 wherein (A) is present in an amount of about 10 to about 8000 ppm and (B) is present in an amount of about 10 to about 200 ppm.

42. A method for stabilizing a liquid hydrocarbon fuel during storage, which fuel contains (A) an overbased titanium or manganese salt of an organic acid, said method comprising:

adding to the fuel an effective amount of an additive comprising:

(B) a compound represented by the general formula (I):

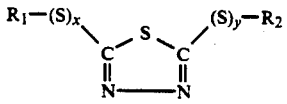

(I)

wherein $R_1$ and $R_2$ are independently hydrogen or hydrocarbyl groups containing about 8 to about 12 carbon atoms and x and y are independently an integer in the range of from about 1 to about 8, provided that at least one of $R_1$ or $R_2$ is said hydrocarbyl, and (C) a hydrocarbon-soluble ashless dispersant.

43. The method of claim 42 wherein x and y are each 2 and $R_1$ and $R_2$ are independently selected from the group consisting of t-octyl, dodecyl, nonyl, decyl, and ethylhexyl.

44. The method of claim 43 wherein (B) is a bis-2,5-tert-octyldithio-1,3,4-thiadiazole.

45. The method of claim 43 wherein (B) is 2-dodecyldithio-5-mercapto-1,3,4-thiadiazole.

46. The method of claim 42 wherein the organic acid is a carboxylic acid.

47. The method of claim 42 wherein the metal is manganese.

48. The method of claim 42 wherein (B) is a mixture of compounds represented by the general Formula I.

49. The method of claim 42 wherein the liquid hydrocarbon fuel is a diesel fuel and (A) is an overbased manganese metal salt of a carboxylic acid.

50. The method of claim 42 wherein (C) is a substituted succinic acid or derivative thereof.

51. The method of claim 50 wherein (C) is a derivative of a substituted succinic acid and the substituent groups are derived from a polyalkylene characterized by a Mn value of about 500 to about 10,000 and a Mw/Mn value of about 1.0 to about 4.0.

52. The method of claim 42 wherein the weight ratio of (A):(B):(C) is in the range of about (1-20):(1-20)-(2-40).

53. The method of claim 52 wherein the weight ratio of (A):(B):(C) is in the range of about (1):(1):(2).

54. The method of claim 42 wherein (A) is present in the liquid hydrocarbon fuel in an amount of about 10 to about 8000 ppm and (B) is present in an amount of about 10 to about 200 ppm.

* * * * *